US005618202A

United States Patent [19]

Okuyama et al.

[11] Patent Number: 5,618,202

[45] Date of Patent: Apr. 8, 1997

[54] CONNECTOR HAVING STRIP LINE STRUCTURE

[75] Inventors: Takeshi Okuyama; Kouji Watanabe; Nobuo Yatsu; Masahiko Sakuraoka; Junichi Akama, all of Kawasaki, Japan

[73] Assignee: Fujitsu Ltd., Kawasaki, Japan

[21] Appl. No.: 351,515

[22] Filed: Dec. 7, 1994

[30] Foreign Application Priority Data

Jan. 31, 1994 [JP] Japan ..... 6-009606

[51] Int. Cl.[6] ..... H01R 23/66

[52] U.S. Cl. ..... 439/497; 439/579

[58] Field of Search ..... 439/579, 497, 439/607, 608, 610, 108

[56] References Cited

U.S. PATENT DOCUMENTS

| | | | |
|---|---|---|---|
| 4,616,893 | 10/1986 | Feldman | 339/14 R |
| 4,695,106 | 9/1987 | Feldman et al. | 439/83 |
| 4,747,787 | 5/1988 | Siwinski | 439/108 |
| 4,757,845 | 7/1988 | Siwinski | 140/105 |
| 4,762,500 | 8/1988 | Dola et al. | 439/79 |
| 4,767,345 | 8/1988 | Guttes et al. | 439/497 |
| 4,860,447 | 8/1989 | Nicholas et al. | 29/753 |
| 4,860,801 | 8/1989 | Nicholas et al. | 140/105 |
| 4,897,046 | 1/1990 | Tengler et al. | 439/579 |
| 4,907,979 | 3/1990 | Feldman | 439/83 |
| 5,161,987 | 11/1992 | Sinisi | 439/101 |
| 5,174,770 | 12/1992 | Sasaki et al. | 439/607 |
| 5,176,538 | 1/1993 | Hansell, III et al. | 439/607 |
| 5,195,899 | 3/1993 | Yatsu et al. | 439/101 |
| 5,281,150 | 1/1994 | Bundga et al. | 439/497 |
| 5,387,125 | 2/1995 | Davis et al. | 439/497 |

*Primary Examiner*—Neil Abrams
*Assistant Examiner*—Brian J. Biggi
*Attorney, Agent, or Firm*—Staas & Halsey

[57] ABSTRACT

A connector for coaxial cables in the form of three flat cables. The coaxial cables are arranged in the cable holder in three rows, so that bared signal conductors extend straight from the cable holder in the insulating body of the connector and ground conductors or ground wires remain in the cable holder. The connector includes wide ground contacts which are inserted in the cable holder to contact the ground conductors or ground wires of the coaxial cables under pressure, and three rows of signal contacts to which bared ends of signal conductors of the coaxial cables are soldered. Three rows of signal contacts are supported by three parallel support plates, respectively. The ground contacts are arranged between first and second rows of the signal contacts and between second and third rows of the signal contacts. A ground shell surrounds the signal contacts whereby a multi-layer strip line structure is formed.

31 Claims, 12 Drawing Sheets

CONNECTOR HAVING STRIP LINE STRUCTURE

BACKGROUND OF THE INVENTION

1. Field of the Invention

The present invention relates to a connector for coaxial cables, suitable for forming a strip line structure.

2. Description of the Related Art

In order to meet demands for increasing transmission speed and realizing multipurpose uses in the field of computers, it is necessary to establish impedance matching for reducing the reflection of signals and the crosstalk. Therefore, it is desirable to use coaxial cables comprising signal conductors, ground conductors surrounding the signal conductors via insulating layers, and an outer covering surrounding the ground conductors.

In the field of printed wiring boards used in computers, multi-layer printed wiring boards are used, on which signal lines are arranged in several planes, and ground (power supply) lines are arranged in the other planes, whereby the signal lines and ground lines constitute a micro-strip structure or a strip line structure. Under these circumstances, it is preferable that a connector located between the coaxial cables and the printed wiring board forms a microstrip structure or a strip line structure.

For example, U.S. Pat. Nos. 4,747,787 and 4,757,845 disclose a connector having a microstrip structure. Also, a connector having a microstrip structure is disclosed in U.S. Pat. Nos. 5,161,987, 4,616,893, 4,695,106, 4,762,500, 4,860,447, 4,860,801 and 4,907,979.

Also, a connector having a strip line structure is disclosed in U.S. Pat. No. 5,195,899.

The connector includes signal contacts connected to a signal conductor of the coaxial cables, and ground contacts connected to ground conductors of the coaxial cables. The connector can be used as a plug connector or a jack connector, and for example, male signal contacts and male ground contacts of the plug connector are respectively connected to female signal contacts and female ground contacts of the jack connector which may be provided in the printed wiring board in the computer.

In a connector having a microstrip structure, two rows of signal contacts are arranged in parallel with each other at a distance between the rows, and a row comprised of a single ground contact or multiple ground contacts (and power supply contact) are arranged between two rows of signal contacts. On the other hand, in a connector having a strip line structure, two rows of signal contacts are arranged in parallel with each other at a distance between the rows, and a row of ground contacts (and power supply contact) are arranged between two rows of signal contacts, and further, straight grounds are arranged outside of the two rows of signal contacts, so that each row of signal contacts are sandwiched between the row of ground contacts and the straight grounds. In the connector described in the above described United States Patent and having a strip line structure, the ground shell surrounds two rows of signal contacts, and this ground shell has two long and straight sides to constitute the further grounds of the strip line structure.

In the conventional connectors, the signal contacts are soldered to the signal conductors of the coaxial cables, and the ground contacts are also soldered to the ground conductors of the coaxial cables. A plurality of coaxial cables are available in the form of a flat cable or a ribbon cable in which coaxial cables are arranged in a row and coupled to each other as a unit. In order to connect signal conductors of a row of coaxial cables in the flat cable or the ribbon cable to two parallel and spaced apart rows of signal contacts, the signal conductors of the coaxial cables are alternately bent to form a V-shape, so that one signal conductor forming one leg of the V-shape is connected to the signal contact in one row and the next signal conductor forming the other leg of the V-shape is connected to the signal contact in the other row. The ground contacts are arranged at the center line of the V-shape.

In the conventional impedance matched connector, the signal conductors and ground conductors of coaxial cables are to be sorted out, and then, the signal conductors of the coaxial cables are soldered to the signal contacts, and the ground conductors of the coaxial cable are soldered to the ground contacts. Therefore, it takes much time and labor to carry out the harness work. Further, the signal contacts are soldered after the signal conductors of the coaxial cables have been alternately bent into a V-shape. Accordingly, the harness work is complicated.

Further, since the signal conductors of the coaxial cables are alternately bent and sorted out into legs of a V-shape, the pitch of the signal contacts is twice as long as that of the coaxial cables, so that the size of the connector cannot be reduced. In order that the signal contacts have the same pitch as that of the coaxial cables, for example, two flat cables must be used, and the signal conductors of coaxial cables in one flat cable are connected to one row of signal contacts, and the signal conductors of coaxial cables in another flat cable must be connected to another row of signal contacts. However, this type of connector has not been proposed.

Two parallel rows of signal contacts are arranged at a distance between the rows in the conventional connectors, however, there is no connector in which three parallel rows of signal contacts are arranged at a distance between the adjacent rows. If three rows of signal contacts are arranged parallel to each other at a distance between the adjacent rows and a row of ground contacts are disposed between the respectively adjacent two rows of signal contacts, it is possible to provide a connector in which an impedance is well matched and the size of the connector can be reduced in the direction of the row of signal contacts, and such a connector has been desired.

SUMMARY OF THE INVENTION

One object of the present invention is to provide a connector by which signal conductors and ground conductors of coaxial cables can be relatively easily connected to signal contacts and ground contact(s) of the connector.

Another object of the present invention is to provide a connector by which signal contacts to be connected to signal conductors of coaxial cables can be arranged with a density disposition.

According to the present invention, there is provided a connector for a plurality of coaxial cables having signal conductors and ground conductors. The connector comprises an insulating body; signal contacts connected to signal conductors of coaxial cables; at least two contact support means arranged in the insulating body parallel to each other for supporting the signal contacts, each contact support means supporting the signal contacts in at least one row; at least one ground contact adapted to be electrically connected to ground conductors of the coaxial cables; and each signal contact being soldered to the signal conductor of each coaxial cable, the at least one ground contact being arranged in the insulating body such that the at least one ground contact is forced into contact with the ground conductors of the coaxial cables or additional conductors connected to the ground conductors.

With this arrangement, the signal conductors of coaxial cables are connected to the signal contacts by soldering. When at least one ground contact is inserted in the insulating body, the ground contact is forced into contact with the ground conductors of the coaxial cable or the additional conductors connected to the ground conductor, so that the ground contact is electrically connected to the ground conductors of the coaxial cables. Consequently, it is possible to omit the soldering work for connecting the ground conductors of the coaxial cables to the ground contact. Therefore, the harness work can be simplified.

As described above, at least two contact support means are arranged in the insulating body parallel to each other, and each of two contact support means supports signal contacts in at least one row. For example, the signal conductors of the coaxial cables in one flat cable are soldered to the signal contacts supported by one contact support means, and the signal conductors of the coaxial cables in another flat cable are soldered to the signal contacts supported by another contact support means. Accordingly, it is possible to arrange the signal contacts at the same pitch as that of the coaxial cables, and to establish a dense pin arrangement to thereby reduce the size of the connector.

BRIEF DESCRIPTION OF THE DRAWINGS

The present invention will become more apparent from the following description of the preferred embodiments, with reference to the accompanying drawings, in which.

DESCRIPTION OF THE PREFERRED EMBODIMENTS

Figure 1:
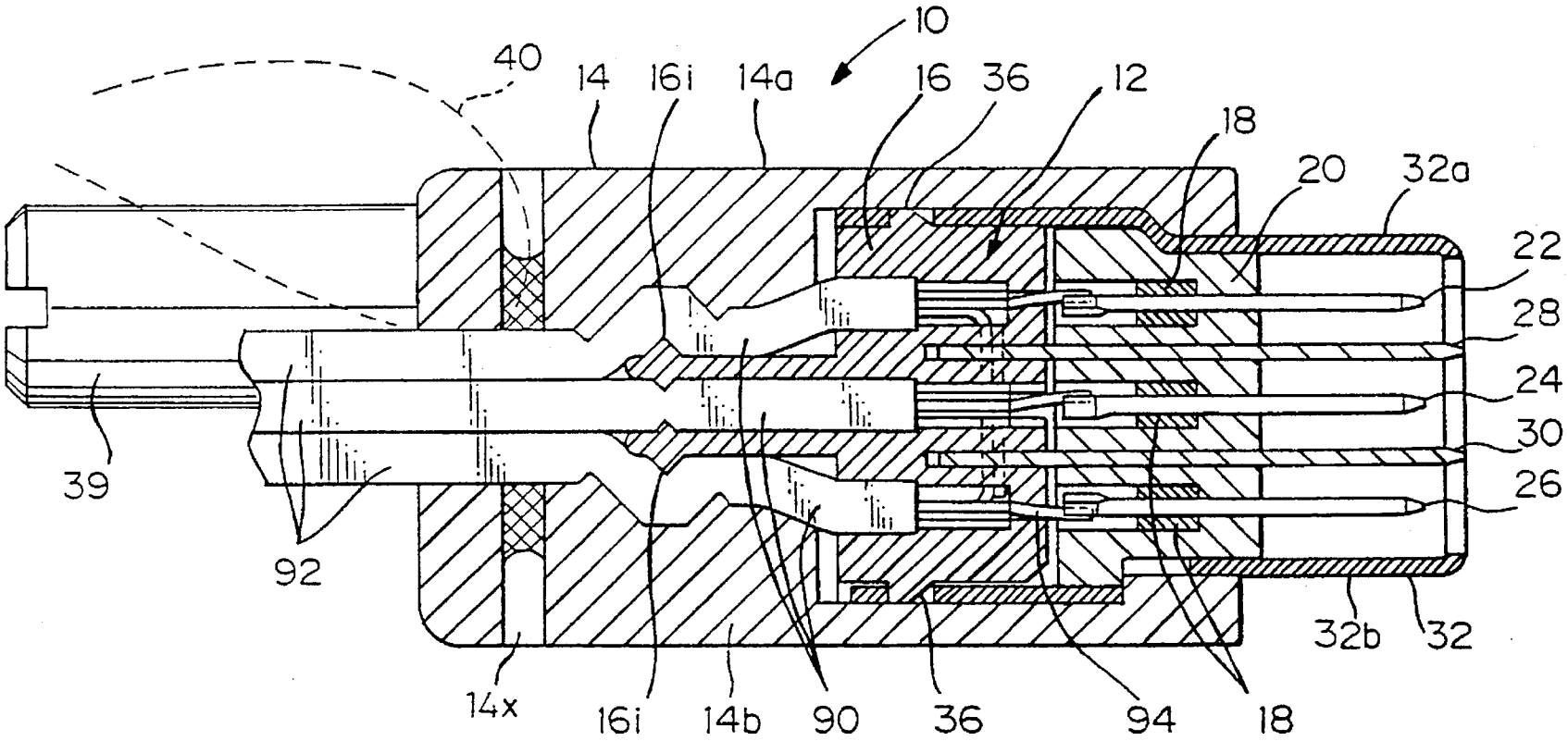
FIG. 1 is a cross-sectional view of the connector according to the first embodiment of the present invention.
Figure 2:
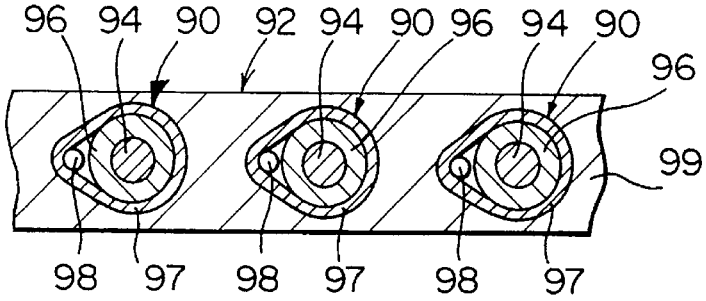
FIG. 2 is a cross-sectional view of the flat cable including a plurality of coaxial cables.
Figure 11:
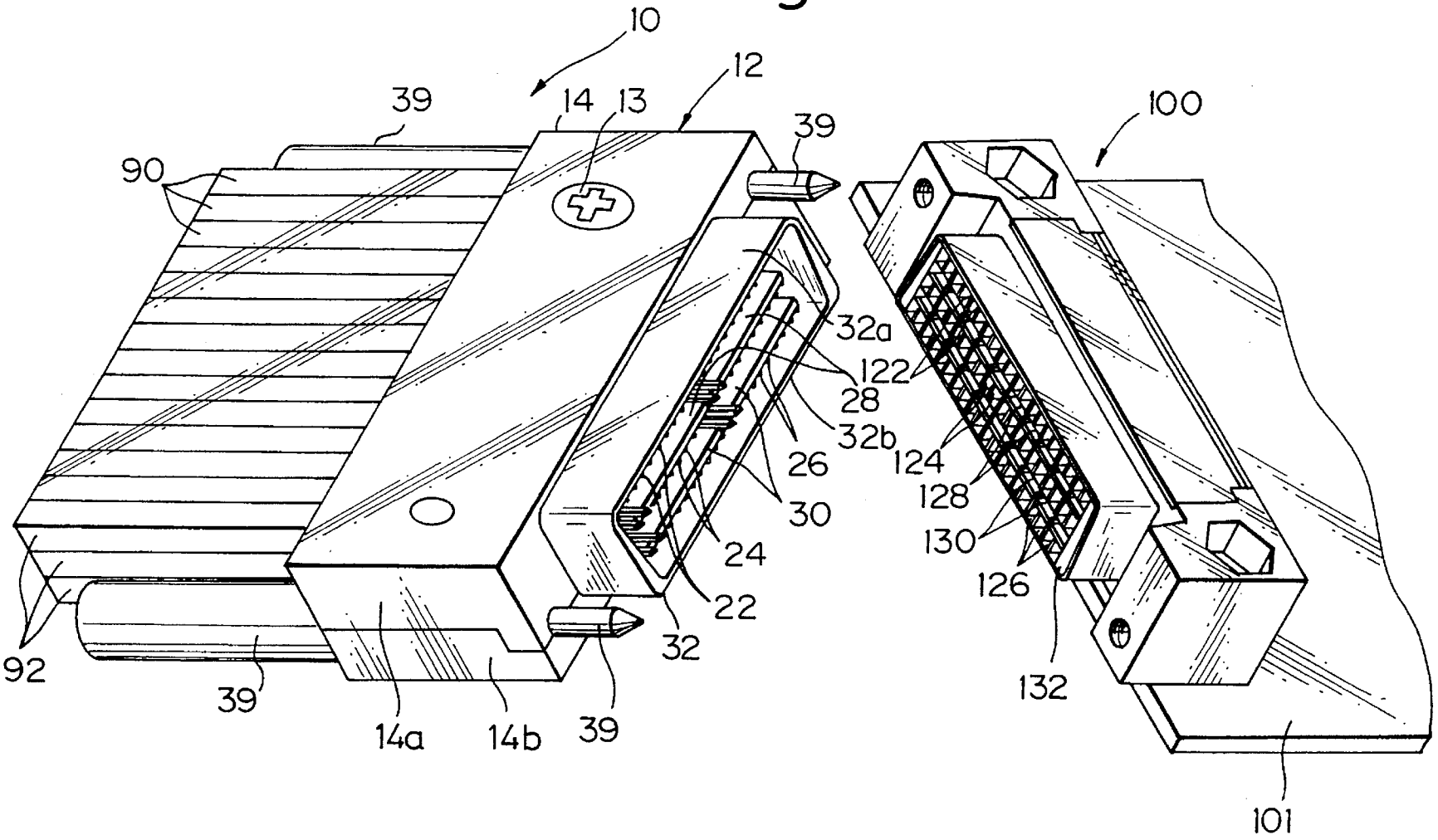
FIG. 11 is a perspective view illustrating the plug connector and the jack connector.

FIG. 1 is a cross-sectional view of the connector 10 according to the first embodiment of the present invention. FIG. 11 shows the connector 10 used as a plug connector 10 and a jack connector 100. FIG. 2 shows a flat cable 92 including coaxial cables 90 to be used in the connector 10 of FIG. 1. As illustrated in FIG. 2, a plurality of coaxial cables 90 are integrally formed with each other in the flat cable 92. Each coaxial cable 90 includes a signal conductor 94 disposed at the center thereof, a ground conductor 97 surrounding the signal conductor 94 via an insulating layer 96, a ground wire 98 extending along the ground conductor 97 as an additional conductor connected to the ground conductor 97, and an outer covering 99. In FIG. 1, three flat cables 92 are put upon each other and attached to the connector 10. That is, upper, intermediate and lower rows of coaxial cables 90, corresponding to three flat cables 92, are disposed.

In FIG. 1, the connector 10 comprises an insulating body 12 and a conductive metallic cover 14. The insulating body 12 includes an insulating cable holder 16 for holding ends of the coaxial cables 90, and an insulating unit 20 for holding three contact support members 18 together in alignment with the cable holder 16. The conductive cover 14 includes a pair of upper and lower cover members **14*a* and 14*b***.

The connector 10 also includes an upper row of signal contacts 22 containing the identical number to that of the coaxial cables 90 in the upper flat cable 92, an intermediate row of signal contacts 24 containing the identical number to that of the coaxial cables 90 in the intermediate flat cable 92, and a lower row of signal contacts 26 containing the identical number to that of the coaxial cables 90 in the lower flat cable 92. The upper row of signal contacts 22, the intermediate row of signal contacts 24, and the lower row of signal contacts 26 are arranged parallel to each other at a distance between the respectively adjacent two rows. The connector 10 further includes at least one ground contact 28 arranged between the upper and intermediate rows of signal contacts 22 and at least one ground contact 30 arranged between the intermediate and lower rows of signal contacts 24. These rows of the ground contacts 28 and 30 may include an electric power supply contact.

Further, a ground shell 32 surrounds three rows of signal contacts 22, 24, and 26, and includes a portion **32*a* extending parallel to the upper row of signal contacts 22 and a portion 32*b* extending parallel to the lower row of signal contacts 26. A distance between the portion 32*a* of the ground shell 32 and the upper row of signal contacts 22 is approximately identical to a distance between the upper row of signal contacts 22 and the ground contact 28. A distance between the ground contact 28 and the intermediate row of signal contacts 24 is approximately identical to a distance between the intermediate row of signal contacts 24 and the ground contact 30. Similarly, a distance between the ground contact 30 and the lower row of signal contacts 26 is approximately identical to a distance between the lower row of signal contacts 26 and the portion 32***b* of the ground shell 32. Accordingly, the strip line structure of transmission is formed by the signal contacts 22, 24 and 26, the ground contacts 28 and 30, and the ground shell 32. In this way, the connector 10 of the present invention is provided with a multi-layer strip line structure, by which the impedance is matched and components can be arranged in a dense formation.

Figure 3:
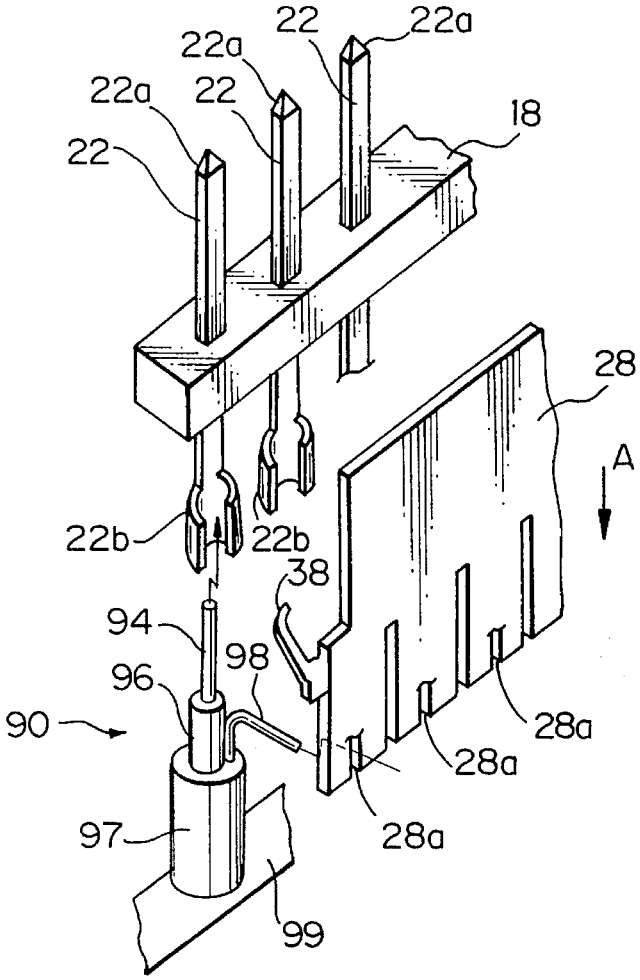
FIG. 3 is an exploded perspective view of the connector, illustrating the connection of the coaxial cable in FIG. 1 to the signal contact and the ground contact.

Each contact support member 18 is a straight and long member which can support a plurality of the signal contacts 22 (24 or 26) in a row, as shown in FIG. 3. Each signal contact 22 (24 or 26) has one end 22*a* adapted to be engaged with a signal contact of the jack connector 100, and the other end 22*b* to which a signal conductor 94 of the coaxial cable 90 is soldered. The other end 22*b* of the signal contact 22 (24 or 26) is formed wider than the remaining portion thereof for facilitating the soldering of the signal conductor 94. The signal contacts 22 (24 or 26) can be integrally formed with the contact support member 18 by means of an insertion molding. Alternatively, the signal contacts 22 (24 and 26) may be press fit into each contact support member 18.

Three contact support members 18 are attached to the insulating unit 20 in parallel with each other, as shown in FIG. 1. Three rows of signal contacts 22, 24 and 26 are provided in the embodiment, but it is possible that two rows of signal contacts may be provided. The insulating unit 20 includes support holes for supporting three contact support members 18, signal contact insertion holes for passing the signal contacts 22, 24 and 26 therethrough, and ground contact insertion holes for passing the ground contacts 28 and 30 therethrough. Therefore, the leading ends of the signal contacts 22, 24 and 26 project from the insulating unit 20, and both ends of the ground contacts 28 and 30 project from the insulating unit 20.

The coaxial cables 90 extend parallel to the axis of the insulating body 12, and the bared signal conductors 94 of the coaxial cables 90 extend substantially along the axis of the insulating body 12 and are soldered to the signal contacts 22, 24 and 26, as shown in FIGS. 1 and 3. The ground wires 98 of the coaxial cables 90 are bent laterally with respect to the bared signal conductors 94 exposed from the outer coverings 99. The ground contacts 28 and 30 are inserted into the insulating body 12 in the direction indicated by the arrow A in FIG. 3 which is parallel to the axis of the insulating body 12, so that the ground contacts 28 and 30 are forced into contact with the bent portions of the ground wires 98. More particularly, the ground contacts 28, 30 have shallow grooves 28*a*, into which the ground wires 98 respectively enter when the ground contacts 28 and 30 are pushed into the insulating body 12 in the direction of the arrow A. By further pushing the ground contacts 28, 30 in the direction of the arrow A, the ground wires 98 are urged to the respective bottoms of the shallow grooves 28*a*, and pinched by the opposite side surfaces of the shallow grooves 28*a*. In this way, the ground wires 98 are brought into contact with, and forcibly engaged by, the ground contacts 28 and 30 and thus are held under pressure therein. In this case, the width of the shallow grooves 28 is slightly smaller than the diameter of the ground wires 98.

The cable holder 16 comprises two holder members 16*a* and 16*b* each of which can hold at least one row of coaxial cables 90 and which can be coupled together.

Figure 4:
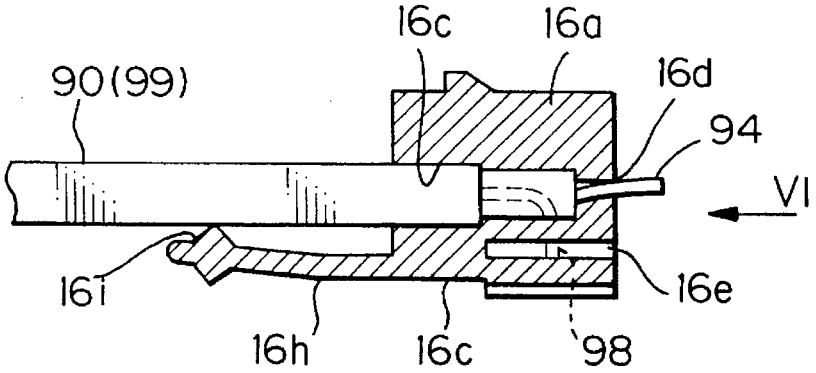
FIG. 4 is a cross-sectional view of one of the holder members of FIG. 1, and taken along the line IV—IV in FIG. 6.
Figure 5:
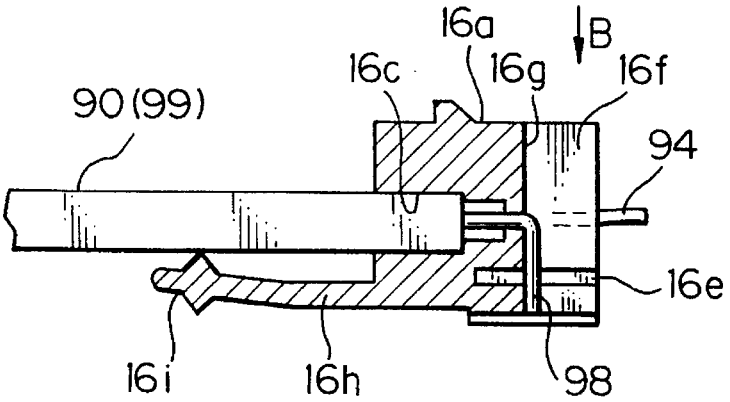
FIG. 5 is a cross-sectional view of the same holder member, and taken along the line V—V in FIG. 6.
Figure 6:
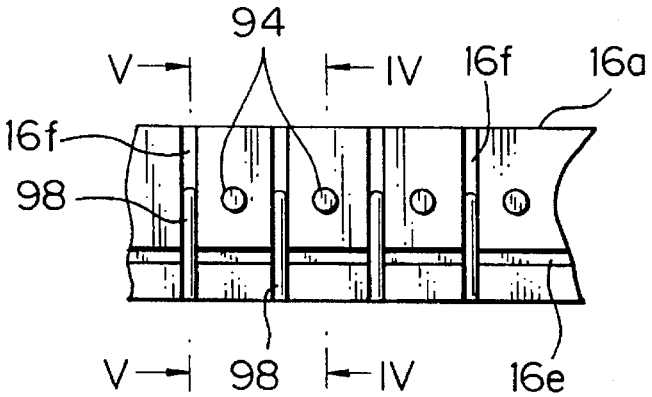
FIG. 6 is an end view of the holder member of FIG. 4, viewed from the arrow VI in FIG. 4.
Figure 7:
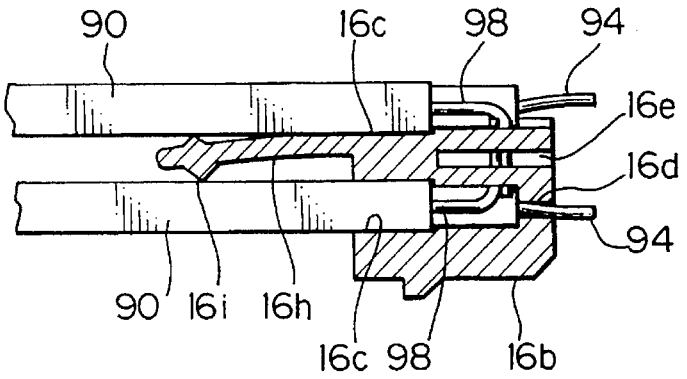
FIG. 7 is a cross-sectional view of the other holder member of FIG. 1.

FIGS. 4 to 6 show one holder member 16*a*, and FIG. 7 shows the other holder member 16*b*. In the embodiment, one holder member 16*a* holds the upper row of coaxial cables 90 corresponding to the one row of signal contacts 22 supported by the upper contact support member 18, and the other holder member 16*b* holds the intermediate and lower coaxial cables 90 corresponding to two rows of signal contacts 24 and 26 supported by the intermediate and lower contact support members 18.

In FIGS. 4 to 6, the holder member 16*a* includes support holes 16*c* for supporting the end portions of the coaxial cables 90 with the outer coverings 99, signal conductor insertion holes 16*d* in substantial alignment with the support holes 16*c* for passing therethrough the signal conductors 94 exposed from the outer coverings 99 and the insulating layers 96 therearound, a ground contact insertion slot 16*e* disposed adjacent to the signal conductor inserting holes 16*d* and extending in a direction substantially parallel to a plane formed by the row of coaxial cables 90; and ground wire insertion slots 16*f* disposed adjacent to the signal conductor inserting holes 16*d* and intersecting the ground contact insertion slot 16*e*.

After the ground wires 98 are inserted into the respective ground wire insertion slots 16*f*, the ground wires 98 are bent along the bottoms 16*g* of the respective ground wire insertion slots 16*f*, using a tool (not shown) moved in the ground wire inserting slots 16*f* in the direction of the arrow B in FIG. 5. At this time, the ground wires 98 intersect the respective ground contact insertion slot 16*e*, as shown in FIG. 6. When the ground contact 28 or 30 is subsequently inserted into the ground contact inserting slot 16*e*, the ground contact 28 or 30 comes into contact with the respective ground wires 98 extending in the ground wire insertion slots 16*f* under pressure. That is, the ground contact 28 or 30 is forced into contact with the respective ground wires 98 which are rested against the bottoms 16*g* of the ground wire insertion slots 16*f*.

In FIG. 7, similarly to the holder member 16*a*, the holder member 16*b* includes support holes 16*c* for supporting the ends of the coaxial cables 90 with the outer coverings 99, signal conductor insertion holes 16*d* for passing therethrough the signal conductors 94 exposed from the outer coverings 99 and the insulating layers 96 therearound, a ground contact insertion slot 16*e*, and ground wire insertion slots 16*f*. The ground wire insertion slots 16*f* are common to the intermediate and lower rows of the ground wires 98 and the respective ground wires 98 in the intermediate and lower rows are bent oppositely to be put one upon another. However, regarding the support holes 16*c*, the signal conductor insertion holes 16*d* and the ground wire insertion slots 16*f* for intermediate rows of coaxial cable 90 are partially formed in the holder member 16*a* and partially formed in the holder member 16*b*, so that they are completed when the holder members 16*a* and 16*b* are coupled together.

Figure 8:
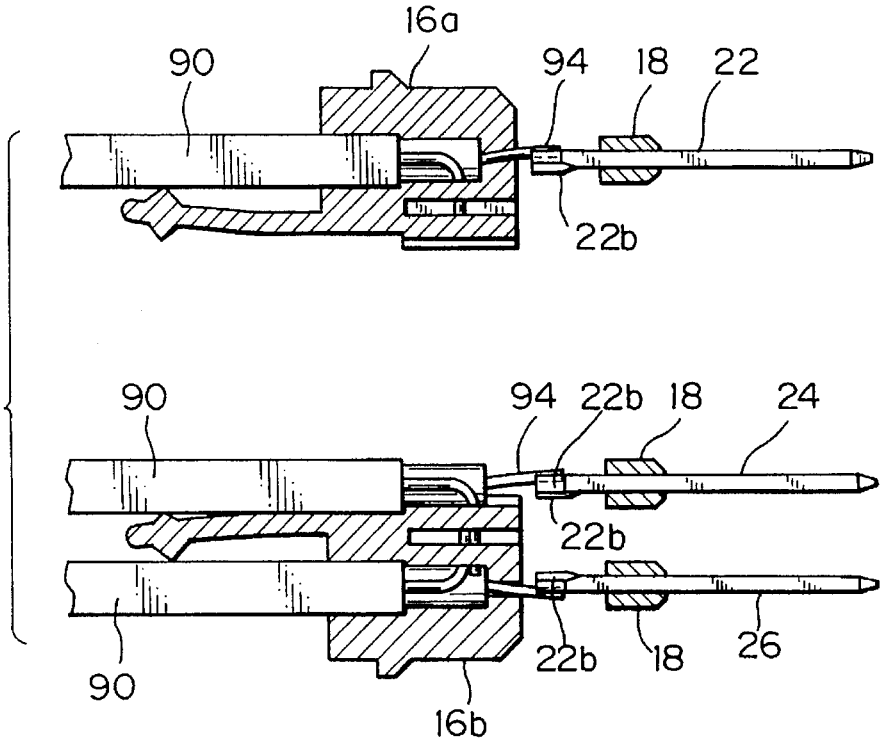
FIG. 8 is a cross-sectional view illustrating the soldering step of the signal contacts.

In the assembly of the connector 10, three rows of coaxial cables 90 are attached to the two holder members 16*a* and 16*b*, separately from three rows of signal contacts 22, 24 and 26 supported by the contact support members 18. The signal conductors 94 of the coaxial cables 90 projecting from the end surfaces of the holder members 16*a* and 16*b* are then soldered to the signal contacts 22, 24 and 26 supported by the contact support member 18, respectively, as shown in FIG. 8. Soldering is carried out prior to the coupling of the holder members 16*a* and 16*b* and three contact support members 18 together. Accordingly, even if the signal conductors 94 in each row and the signal contacts 22, 24, 26 in each row are arranged close to each other, soldering can be performed relatively easily since the signal conductors 94 extend substantially straight and soldering can be carried out for each row. In addition, the signal conductor insertion holes 16*d* are slightly tapered toward the surfaces of widened ends of the signal contacts 22, 24, 26 to be soldered, so that the signal contacts 22, 24, 26 in the adjacent rows do not approach each other during soldering, as shown in FIGS. 4 to 8.

Figure 9:
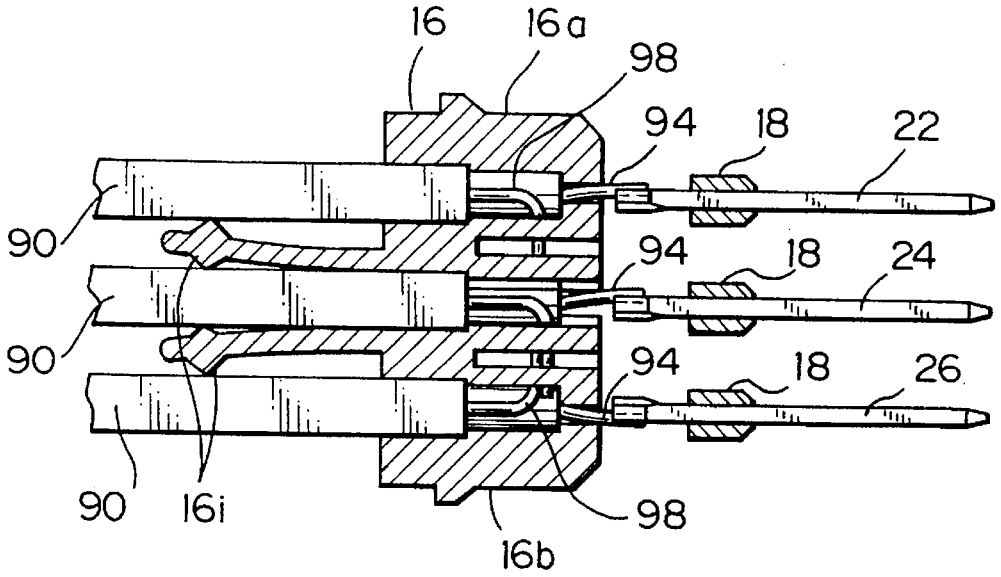
FIG. 9 is a cross-sectional view illustrating the coupling step of two holder members.
Figure 10:
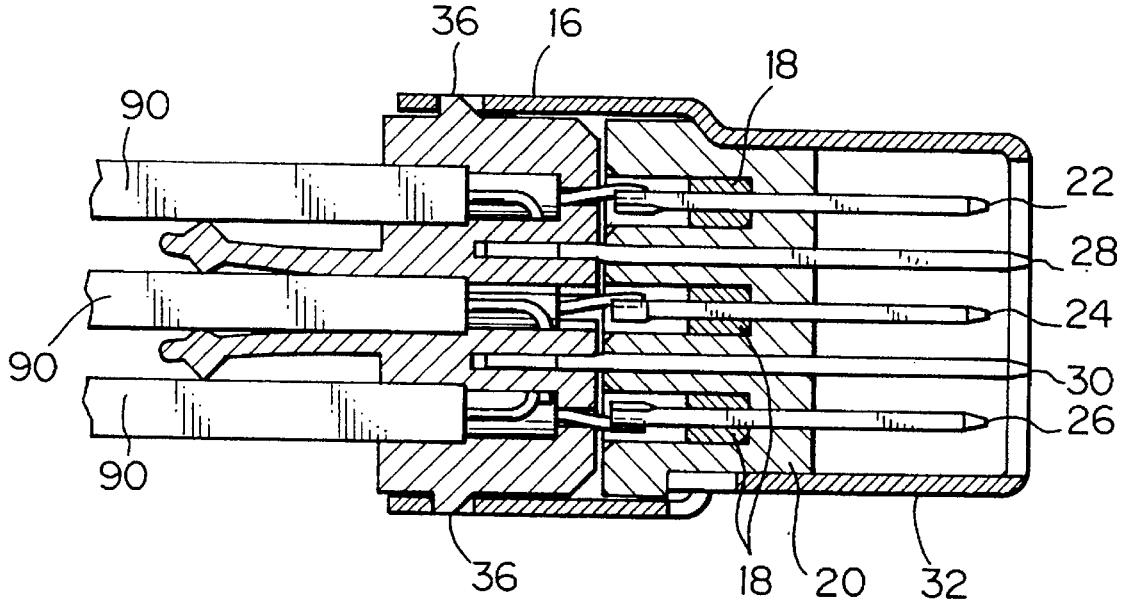
FIG. 10 is a cross-sectional view illustrating the installing step of the ground contacts and the ground shell.

Two holder members 16*a* and 16*b* are then coupled together to become the cable holder 16, as shown in FIG. 9, and three contact support members 18 are then inserted into the insulating unit 20, as shown in FIG. 10. The ground contacts 28 and 30 are then inserted into the insulating unit 20 and the cable holder 16, so that the ground contacts 28 and 30 are urged to the ground wires 98 of the coaxial cables 90. The ground shell 32 is then attached to the outer peripheries of the insulating unit 20 and the cable holder 16 so as to surround the signal contacts 22, 24 and 26. The cable holder 16 has resilient claws 36 which are engaged with the openings of the ground shell 32 prevent the ground shell 32 from being released.

The ground contacts 28 and 30 have resilient contact portions 38 at the lateral sides thereof, as shown in FIG. 3. The contact portions 38 are brought into contact with the inside of the ground shell 32 when the ground shell 32 is attached, and the ground shell 32 is thus electrically connected to the ground contacts 28 and 30.

The holder members 16*a*, 16*b* have rearwardly extending leg portions 16*h* with protrusions 16*i* at the rear ends of the latter, respectively, as shown in FIGS. 4 and 7. The leg portions 16*h* and the protrusions 16*i* are located between two adjacent rows of coaxial cables 90 so as to compress the outer coverings 99 of the coaxial cables 90 to retain the outer covering 99 of the coaxial cable 90, by a force applied to a pair of upper and lower cover members 14*a*, 14*b* when the cover 14 is finally attached to the body, as shown in FIG. 1. In order to further reliably hold the coaxial cables 90, a potting resin or an adhesive can be applied into the cover or body via a through hole 14*x* formed therein.

The cover 14 also includes screws 39 for fixing the connector 10 (used as a plug connector 10) to the jack connector 100 and a pull tab 40 for pulling out the plug connector 10 from the jack connector 100, as shown in FIGS. 1 and 11. A screw 13 joins the upper and lower cover members 14*a* and 14*b* together.

Figure 12:
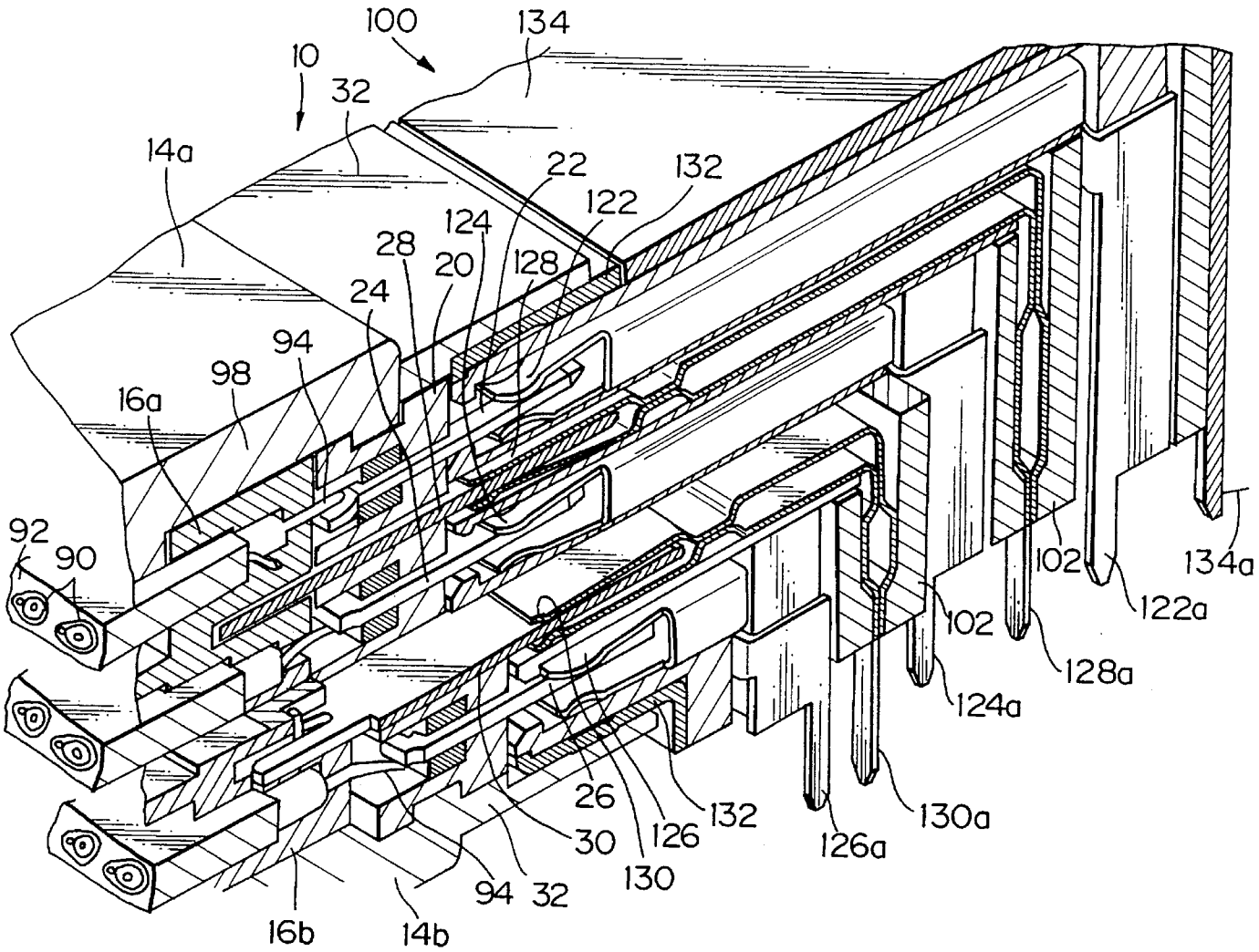
FIG. 12 is a perspective cross-sectional view illustrating the fit plug and jack connectors.

FIGS. 11 and 12 show the plug connector 10 and the jack connector 100 connected to this plug connector 10. The plug connector 10 corresponds to the connector 10 illustrated in FIGS. 1 to 10. However, in FIGS. 11 and 12, the cover 14 and the ground shell 32 are integrally formed together. That is, the cover 14 comprises a pair of upper and lower cover members 14*a* and 14*b*, and the ground shell 32 is formed integrally with the lower cover member 14*b*.

The jack connector 100 is attached, for example, to a printed wiring board 101 of a computer. The jack connector 100 includes female signal contacts 122, 124 and 126 adapted to engage with the signal contacts 22, 24 and 26 of the plug connector 10, and female ground contacts 128 and 130 adapted to engage with the ground contacts 28 and 30 of the plug connector 10. The female signal contacts 122, 124 and 126 and the female ground contacts 128 and 130 are arranged in an insulating body 102, bent downward in the body 102 at right angles, and project from the body 102 as contact leads 122*a*, 124*a*, 126*a*, 128*a* and 130*a*, respectively. These contact leads are connected to the printed wiring board 101.

The jack connector 100 also includes a ground shell 132 surrounding the female signal contacts 122, 124 and 126. A cover plate 134 covers the upper row of the female contacts 122 and is bent at right angles, in a manner similar to the female contacts 122, and terminates as a ground lead 134*a*. The ground lead 134*a* is also connected to the printed wiring board 101. The ground shell 132 is connected to the cover plate 134, and accordingly, a strip line structure for transmission is also formed in the jack connector 100, by the female contacts 122, 124 and 126, the female ground contacts 128 and 130, the ground shell 132, and the cover plate 134. Further, when the plug connector 10 is engaged with the jack connector 100, the ground shell 132 is engaged with the ground shell 32.

Figure 13:
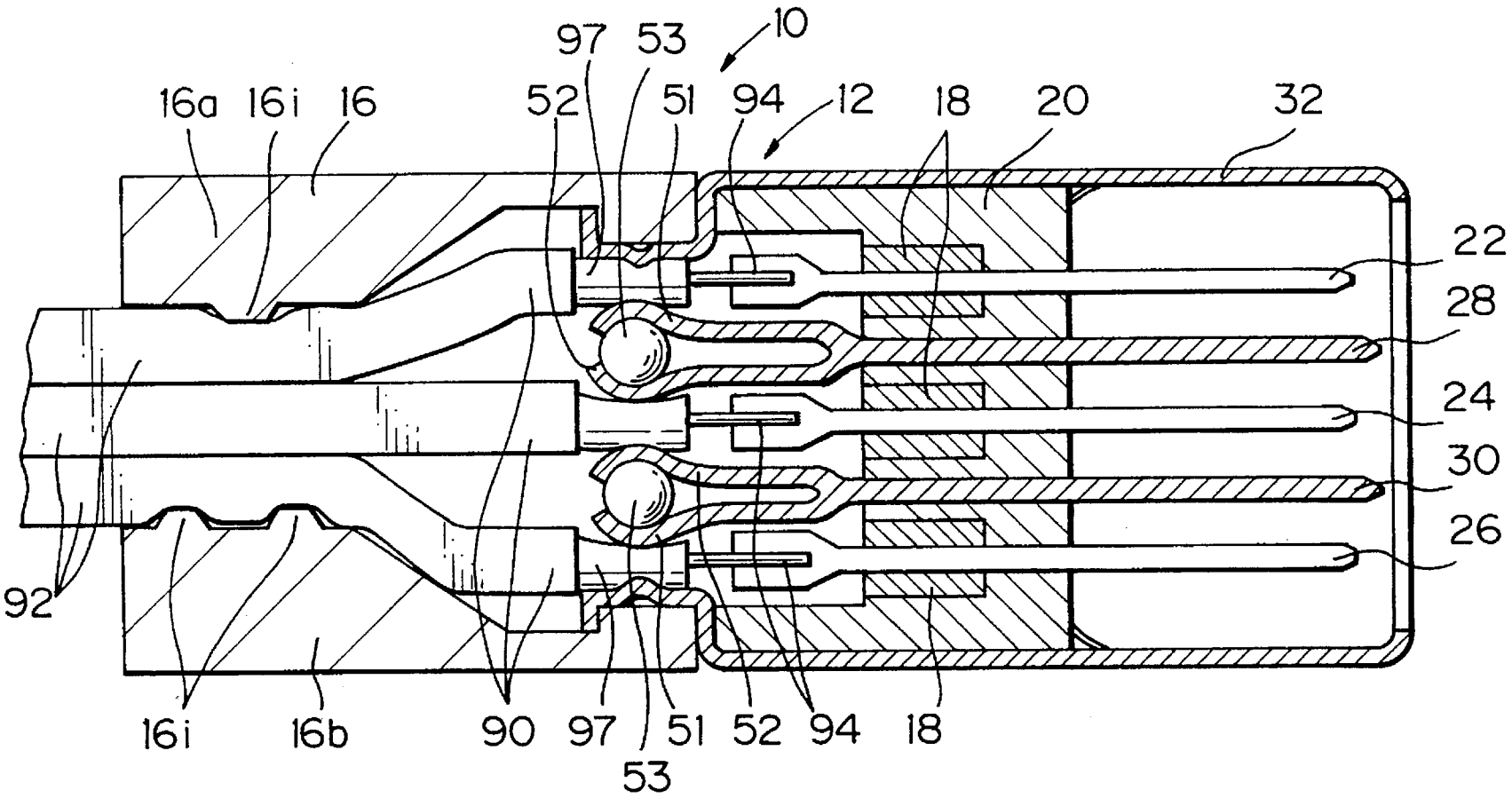
FIG. 13 is a cross-sectional view of the connector according to the second embodiment of the present invention.
Figure 14:
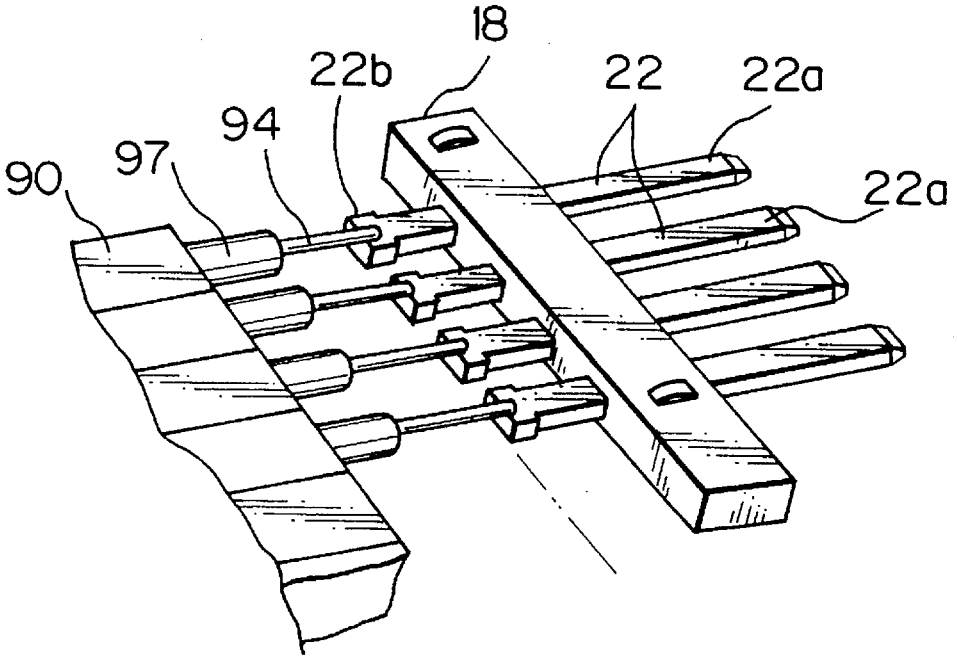
FIG. 14 is a perspective view illustrating the signal contacts supported by the contact support member of FIG. 13 and coaxial cables.

FIGS. 13 and 14 show the connector 10 according to the second embodiment of the present invention. Similarly to the connector 10 in FIG. 1, this connector 10 can be also used as a plug connector. In FIG. 13, the connector 10 uses the flat cables 92 including the coaxial cables 90 shown in FIG. 2. As explained previously with reference to FIG. 2, the coaxial cable 90 includes the central signal conductor 94, the insulating layer 96, the ground conductor 97, the ground wire 98 and the outer covering 99. In FIG. 13, three flat cables 92 are put upon each other and attached to the connector 10. In this way, a plurality of coaxial cables 90 are disposed in each of the upper, intermediate, and lower rows.

In FIG. 13, the connector 10 comprises an insulating body 12, which includes an insulating cable holder 16 for holding ends of the coaxial cables 90, and an insulating unit 20 arranged in alignment with the cable holder 16 for holding three contact support members 18 together. In this embodiment, the signal conductors 94 of the coaxial cables 90 are exposed and project from the insulating layers 96, and the ground conductors 97 are exposed from the outer coverings 99 and brought into contact with the ground contacts, in a manner described below. The ground wires 98 are cut together with the ends of the ground conductors 97. In this embodiment, it is possible to use coaxial cables having no ground wires 98.

The connector 10 includes a row of signal contacts 22 connected to the upper row of signal conductors 94 of the coaxial cables 90 of the upper flat cable 92, a row of signal contacts 24 connected to the intermediate row of signal conductors 94 of the coaxial cables 90 of the intermediate flat cable 92, and a row of signal contacts 26 connected to the lower row of signal conductors 94 of the coaxial cables 90 of the lower flat cable 92. The upper, intermediate, and lower rows of signal contacts 22, 24 and 26 are arranged parallel to each other at a distance between two adjacent rows. The connector 10 further includes at least one ground contact 28 arranged between the upper row of signal contacts 22 and the intermediate row of signal contacts 24, and at least one ground contact 30 arranged between the intermediate row of signal contacts 24 and the lower row of signal contacts 26. The rows of the ground contacts 28 and 30 may include an electric power supply contact. Further, the ground shell 32 surrounds three lines of signal contacts 22, 24 and 26, and accordingly, the strip line structure for transmission is formed by the signal contacts 22, 24 and 26, the ground contacts 28 and 30 and the ground shell 32. In this case too, the connector 10 has a multi-layer strip line structure as described above, by which the impedance is matched and components can be arranged in a highly density disposition.

As shown in FIG. 14, each contact support member 18 is a straight and elongated member which can support the signal contacts 22 (24 or 26) in a row. Each signal contact 22 (24 and 26) has one end 22*a* adapted to be engaged with a signal contact of the jack connector 100, and the other end 22*b* to which a signal conductor 94 of the coaxial cable 90 is soldered. The width of the other end 22*b* is formed wider than the remaining portion thereof for facilitating soldering the signal conductor 94. The signal contacts 22 (24 and 26) can be integrally formed with each contact support member 18 into one body by insertion molding. Alternatively, the signal contacts 22 (24 and 26) may be press fit into each contact support member 18.

Accordingly, in this case too, the signal conductors 94 of the coaxial cables 90 can be soldered to the signal contacts 22, 24 and 26 supported by the contact support members 18 in the straight position. The insulating unit 20 includes supporting holes for supporting three contact support members 18, signal contact insertion holes for passing therethrough the signal contacts 22, 24 and 26, and ground contact insertion holes for passing therethrough the ground contacts 28 and 30. The ends of the signal contacts 22, 24 and 26 and the ground contacts 28 and 30 project from the insulating unit 20.

As shown in FIG. 13, the outer ends of the ground contacts 28, 30 are adapted to be connected to ground contacts 128 and 130 of the jack connector 100 (see FIG. 11). Inner ends of the ground contacts 28 and 30 are formed to forcibly contact the ground conductors 97. For this purpose, the inner ends of the ground contacts 28 and 30 are formed into a fork-shape having first and second arms 51 and 52. The first arm 51 forcibly contacts the ground conductors 97 of the coaxial cables 90 in one of two adjacent rows. The second arm 52 forcibly contacts the ground conductors 97 of the coaxial cables 90 in the other of two adjacent rows.

As shown in FIG. 13, a cylindrical insertion 53 made of elastomeric material is inserted between the first and second arms 51, 52 on the inner ends of the ground contacts 28 and 30 so that the first and second arms 51 and 52 are forcibly spread out. In this way, the first and second arms 51 and 52 are forced into contact with the corresponding ground conductors 97. In this embodiment, the ground contacts 28 and 30 are first inserted in the insulating unit 20, then three contact support members 18 respectively connected to the signal contacts 22, 24 and 26 are inserted into the insulating unit 20, and then the elastomeric cylindrical insertion 53 is inserted between the first and second arms 51 and 52 on the inner ends of the ground contacts 28 and 30 in the transverse direction with respect to the ground contacts 28 and 30. The ground shell 32 is then attached to the outer periphery of the insulating unit 20, and the ground shell 32 is electrically connected to the ground conductors 97 of the coaxial cables 90. After that, the insulating holder 16 is attached. The cable holder 16 comprises two holder members 16*a* and 16*b* which are coupled together. The holder members 16*a* and 16*b* have protrusions 16*i* which catch the outer coverings 99 of the coaxial cables 90 when the holder members 16*a* and 16*b* are combined.

Figure 15:
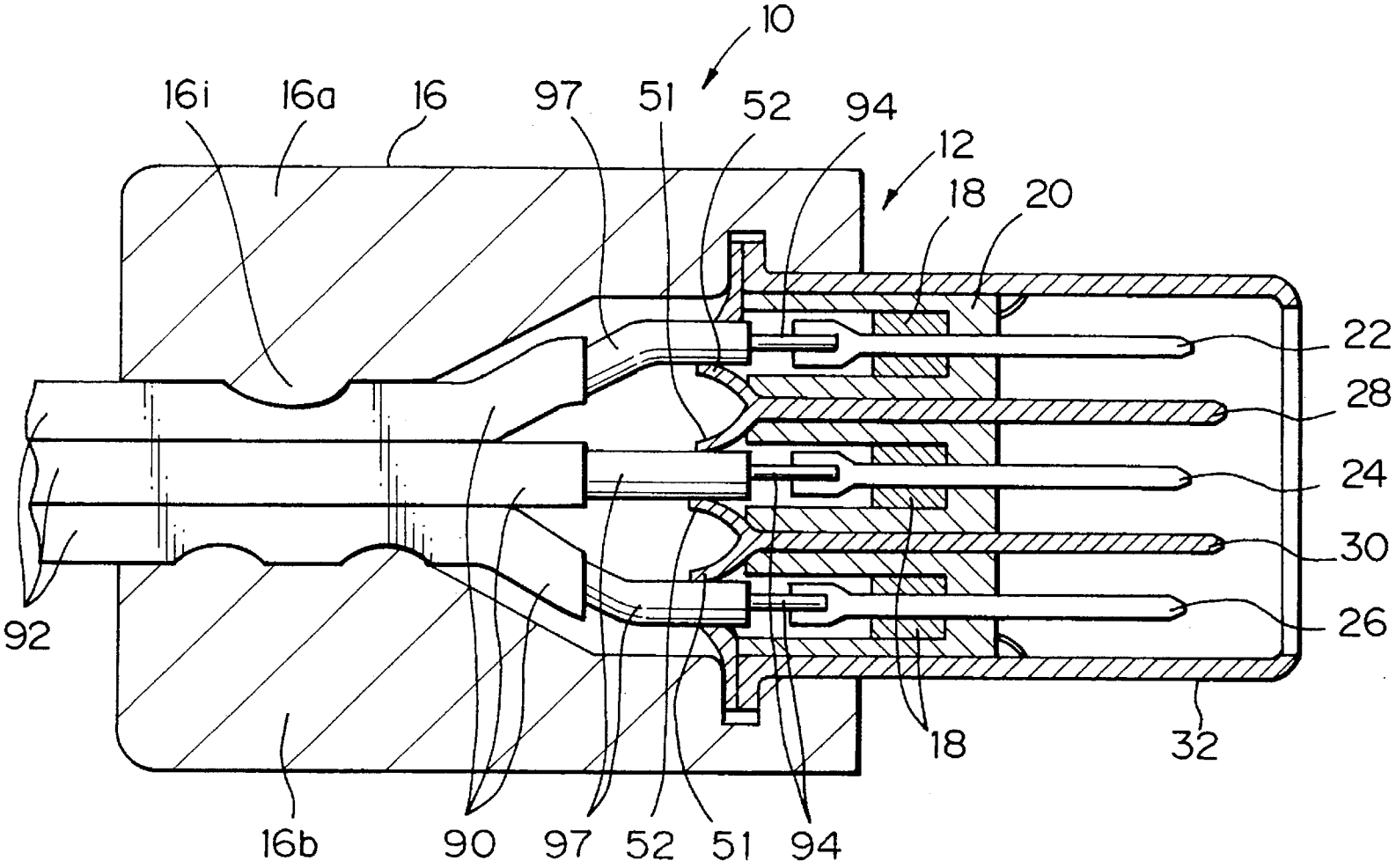
FIG. 15 is a cross-sectional view of the connector according to the third embodiment of the present invention.
Figure 16:
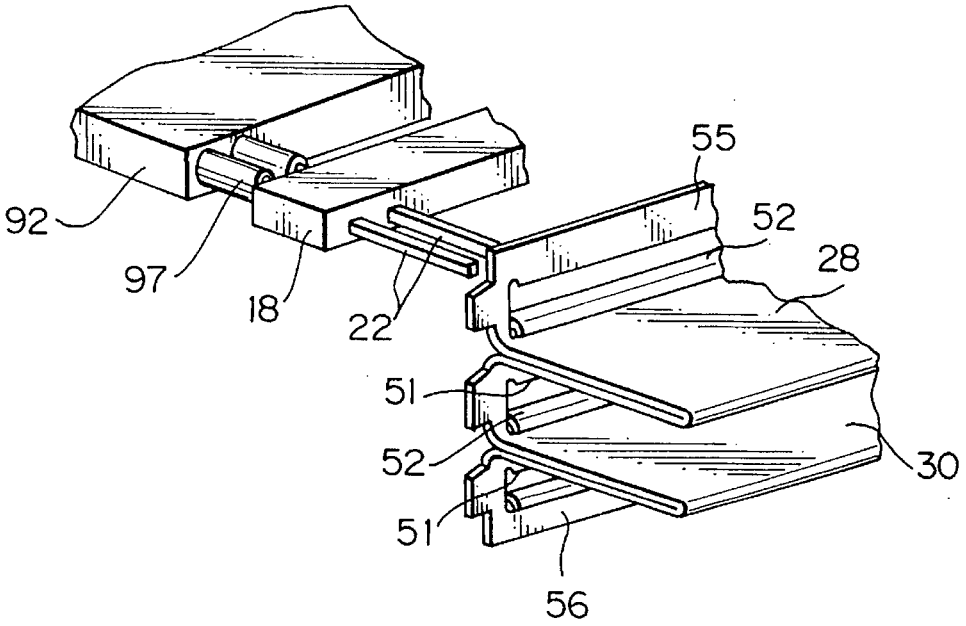
FIG. 16 is an exploded perspective view of a portion of the connector of FIG. 15.

FIGS. 15 and 16 show the connector 10 according to the third embodiment of the present invention. Similar to the connector 10 of FIG. 13, this connector 10 uses three flat cables 92. Each flat cable 92 includes a plurality of coaxial cables 90 as described above. In this embodiment too, the signal conductors 94 of the coaxial cables 90 are exposed and project from the insulating layer 96 and are respectively soldered to the ground contacts 22, 24 and 26 in a straight position. The ground conductors 97 are exposed from the outer coverings 99 and forced into contact with the ground contacts 28 and 30.

The connector 10 comprises an insulating body 12 including an insulating cable holder 16 for holding ends of the coaxial cables 90 and an insulating unit arranged coaxially with the cable holder 16 for holding three contact holding members 18 together. Each contact support member 18 is a straight and long member which supports signal contacts 22 (24 or 26) in a row. The insulating unit 20 includes supporting holes for supporting three contact support members 18, signal contact inserting holes for passing therethrough the signal contacts 22, 24 and 26, and ground contact inserting holes for inserting the ground contacts 28 and 30. Ends of the signal contacts 22, 24, 26 and the ground contacts 28 and 30 project from the insulating unit 20. Further, the ground shell 32 surrounds three rows of signal contacts 22, 24 and 26. Therefore, the signal contacts 22, 24 and 26, the ground contacts 28 and 30, and the ground shell 32 form a strip line structure for transmission.

Outer ends of the ground contacts 28 and 30 are connected to the ground contacts 128 and 130 of the jack connector 100 (see FIG. 11). Inner ends of the ground contacts 28 and 30 resiliently contact the ground conductors 97. Each inner end of the ground contacts 28 and 30 is formed into a fork-shape having first and second arms 51 and 52. The first arm 51 is forced into contact with the ground conductors 97 of the coaxial cables 90 in one of two adjacent rows of coaxial cables 90 facing the first arm 51. The second arm 52 is forced into contact with the ground conductors 97 of the coaxial cables 90 in the other row.

As shown in FIG. 16, each of the ground contacts 28 and 30 is formed from a metallic plate subjected to folding and cutting, and includes an upper edge portion 55 and a lower edge portion 56. In this embodiment, three contact support members 18 connected to the signal contacts 22, 24 and 26 pass through openings formed between the first and second arms 51 and 52 of the ground contacts 28 and 30. When the signal contacts 22, 24 and 26 and the contact support members 18 pass through the openings formed between the first and second arms 51 and 52, the ground conductors 97 are engaged with the first and second arms 51 and 52.

Figure 17:
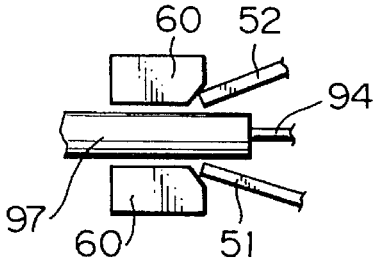
FIG. 17 is a perspective view illustrating the deforming step of the ground contact of FIG. 15.
Figure 18:
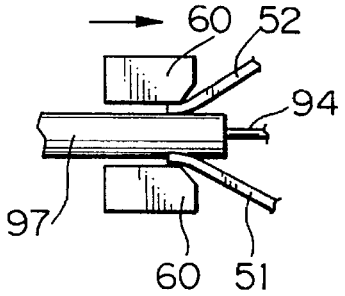
FIG. 18 is a view illustrating the successive step of FIG. 17.

Tools 60 shown in FIGS. 17 and 18 are used in this instance. The tools 60 have tapered end portions and are moved toward the first and second arms 51 and 52, as indicated by the arrow in FIG. 18, so that the first and second arms 51 and 52 are deformed so as to forcibly contact the ground conductors 97. After the tools 60 are removed, three contact support members 18 and the ground contacts 28 and 30 are inserted into the insulating unit 20. The ground shell 32 is then attached to the outer periphery of the insulating unit 20. At this time, the end flange of the ground shell 32 comes into contact with upper and lower edges 55 and 56 of the ground contacts 28, 30, so that the ground shell 32 is electrically connected with the ground contacts 28 and 30. The insulating cable holder 16 is then attached. The end flange of the ground shell 32 and the upper and lower edge portions 55 and 56 of the ground contacts 28 and 30 are engaged with the groove of the cable holder 16 and fixed to each other. The cable holder 16 also comprises two holder members 16*a* and 16*b* capable of being combined with each other. The holder members 16*a* and 16*b* have protrusions 16*i* to catch the outer coverings 99 of the coaxial cables 90 when the holder members 16*a* and 16*b* are combined.

Figure 19:
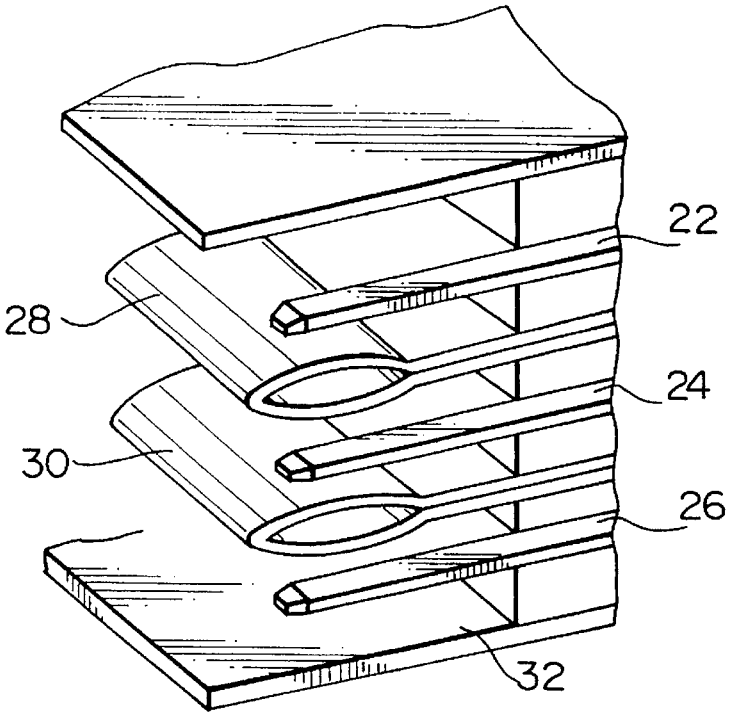
FIG. 19 is a view illustrating a variation of the ground contact.
Figure 20:
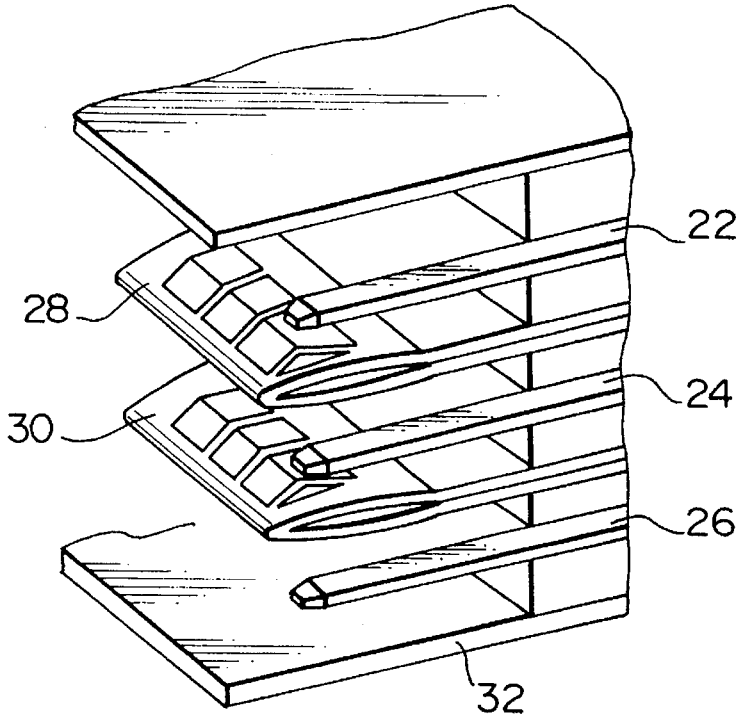
FIG. 20 is a view illustrating another variation of the ground contact.

FIGS. 19 and 20 show variations of the ground contacts 28 and 30 of the connector 10 illustrated in FIGS. 1 to 16. End portions of the ground contacts 28 and 30 are formed so that they can be resiliently deformed. The female ground contacts 128 and 130 of the jack connector 100 shown in FIG. 11 include a pair of resilient walls by which the end portions of the ground contacts 28 and 30 are pinched. Even when the resilience of the female ground contacts 128 and 130 of the jack connector 100 is low, if the end portions of the ground contacts 28 and 30 are resiliently formed, the ground contacts 28 and 30 can reliably contact the female ground contacts 128 and 130.

As shown in FIG. 19, the end portions of the ground contacts 28 and 30 are formed in a bag-shaped double wall structure.

In FIG. 20, the end portions of the ground contacts 28 and 30 are formed in a bag-shaped double wall structure, and in addition, slits are provided in the walls so that a portion of the wall is upwardly deformed into a C-shape spring.

As explained above, according to the present invention, a plurality of signal contacts are supported by each of the contact support means in a row, and the signal conductors of the coaxial cables are connected to the signal contacts supported by the contact support means. At least one ground contact is inserted into the insulating body, and forced into contact with the ground conductors of the coaxial cables or additional conductors connected to the ground conductors, so that the ground contact can be electrically connected to the ground conductors of the coaxial cables. Therefore, the harness work of the connector can be simplified. Since the signal contacts are supported by the contact support means in a row and respectively connected to the signal conductors of the coaxial cables, the signal contacts can be arranged at the same pitch as that of the coaxial cables, so that the components of the connector can be arranged in a very dense disposition and a compact connector can be realized.

We claim:

1. A connector for a plurality of coaxial cables having corresponding signal conductors and ground conductors, said connector comprising:

an insulating body;

signal contacts respectively soldered to the corresponding signal conductors of the coaxial cables and arranged in first and second sets, each set comprising respective, plural signal contacts;

first and second contact supports arranged in the insulating body in parallel relationship and supporting the first and second sets of signal contacts, respectively, in corresponding, first and second parallel rows;

at least one ground contact adapted to be electrically connected to ground conductors of the coaxial cables;

said insulating body comprising an insulating cable holder for holding end portions of respective cables, and an insulating unit coaxially arranged with said insulating cable holder for holding said first and second contact supports together;

said insulating unit comprising at least two support portions for supporting respective contact supports, and at least one through hole arranged between said at least two support portions for the passage of said at least one ground contact therethrough;

one end of each signal contact being soldered to a respective signal conductor of each coaxial cable, said at least one ground contact positioned through said at least one through hole of said insulating unit and having one end forcibly engaged with corresponding ground conductors of said coaxial cables or with additional conductors connected to said corresponding ground conductors.

2. A connector according to claim 1, wherein said at least one ground contact is arranged between at least two rows of signal contacts; and further comprising a ground shell surrounding said at least two rows of signal contacts, whereby a strip line structure is formed by said signal contacts, said at least one ground contact, and said ground shell.

3. A connector according to claim 1, wherein said contact supports comprise three contact supports, and said at least one ground contact comprises two rows of ground contacts, each including at least one ground contact, said at least one ground contact in each row being arranged between two rows of signal contacts that are supported by two adjacent contact supports; and further comprising a ground shell surrounding said three rows of signal contacts, whereby a strip line structure is formed by said signal contacts, said ground contacts, and said ground shell.

4. A connector according to claim 1, wherein the coaxial cables which have signal conductors connected to the signal contacts supported in at least one row by said contact supports are formed as a flat cable.

5. A connector according to claim 1, wherein each coaxial cable includes a signal conductor, a ground conductor surrounding the signal conductor via an insulating layer, a ground wire extending along the ground conductor as the additional conductor, and an outer covering surrounding the ground conductor, said at least one ground contact being arranged in said insulating body such that said at least one ground contact is forced into contact with the ground wires.

6. A connector according to claim 5, wherein said insulating body has an axis, said coaxial cables being arranged in the insulating body parallel to said axis, said signal conductors of the coaxial cables extending substantially along said axis and being soldered to the signal contacts, the ground wires being exposed from the outer coverings and bent laterally with respect to the signal conductors, said at least one ground contact being arranged in the insulating body parallel to said axis so that said at least one ground contact is forced into contact with bent portions of the ground wires.

7. A connector according to claim 6, wherein the insulating body includes an insulating cable holder for holding end portions of the coaxial cables, and an insulating unit coaxially arranged with the cable holder for holding said first and second contact supports together;

the cable holder including support holes for passing therethrough end portions of the respective coaxial cables with the outer coverings, signal conductor insertion holes in substantial alignment with the support holes for passing therethrough the signal conductors exposed from the outer coverings and the insulating layers therearound, a ground contact insertion slot adjacent to the signal conductor insertion hole and extending substantially parallel to a plane which the row of the coaxial cables form, and the ground wire insertion slots adjacent to the signal conductor insertion holes and intersecting the ground contact insertion slot; and the ground wires extending in the ground wire insertion slots and intersecting the ground contact insertion slot, the ground contact being inserted in the ground contact is forced into contact with the ground wires extending in the ground wire insertion slots.

8. A connector according to claim 7, wherein the cable holder comprises at least two holder members which can be coupled together, and each holder member is capable of supporting at least one row of coaxial cables.

9. A connector according to claim 8, wherein said contact supports comprise three contact supports, and said at least one ground contact comprises two rows of ground contacts, each including at least one ground contact, said at least one ground contact in each row being arranged between two rows of signal contacts that are supported by two adjacent contact supports; and one of the holder members is capable of supporting the at least one row of coaxial cables corresponding to the signal contact supported by one contact support, the other holder member being capable of supporting at least one row of coaxial cables corresponding to the signal contacts supported by two contact supports.

10. A connector according to claim 9, further comprising a ground shell surrounding the signal contact, whereby a strip line structure is formed by the signal contacts, ground contacts and ground shell.

11. A connector according to claim 10, wherein the ground shell is electrically connected to at least one ground contact.

12. A connector according to claim 8, further comprising a conductive cover which at least partly surrounds said at least two holder members.

13. A connector according to claim 12, wherein at least one holder member is provided with a protrusion located between two rows of aligned coaxial cables, the cover surrounding at least a portion of said at least two holder members and all the coaxial cables extending from at least two holder members, said protrusion of the holder member being arranged to deform the outer coverings of the coaxial cables when the cover is attached.

14. A connector according to claim 7, wherein said insulating unit includes signal conductor insertion holes corresponding to the signal conductor insertion holes of the cable holder, a ground contact insertion slot corresponding to the ground contact insertion slot of the cable holder, and the ground contact is inserted from the outside of the insulating unit into the ground contact insertion slot of the insulating unit and into the ground contact insertion slot of the cable holder.

15. A connector according to claim 1, wherein:

each coaxial cable further comprises an insulating layer surrounding each of said respective signal conductors, and an outer covering surrounding each of said respective ground conductors; and said ground contact being arranged in said insulating body so as to be forcibly engaged with said respective ground conductors.

16. A connector according to claim 15, wherein the insulating body includes an insulating cable holder for holding end portions of the coaxial cables, and an insulating unit coaxially arranged with the cable holder for holding said first and second contact supports together, the insulating unit including signal contact insertion holes and a ground contact insertion slot.

17. A connector according to claim 15, wherein each ground contact has one end adapted to be connected to a ground contact of a related connector, and the other end contacting the ground conductor under pressure, said other end being forced into contact with the ground conductor under a resilient stress.

18. A connector according to claim 17, wherein the other end of each ground contact has first and second arms divided in the shape of a fork, the first arm being forced into contact with the ground conductors of one of two adjacent rows of coaxial cables, the second arm being forced into contact with the ground conductors of the other row of the coaxial cables.

19. A connector according to claim 18, wherein the ground contact has an insertion between the first and second arms of the other end thereof so that the first and second arms can be spread out to be forced into contact with the associated ground conductors.

20. A connector according to claim 18, wherein after the ground conductors of the coaxial cable are placed at a position where the ground conductors engage with the other end of the ground contact, the first and second arms of the ground contact are deformed by a tool so that the first and second arms are forced into contact with the associated ground conductors.

21. A connector according to claim 15, further comprising a ground shell surrounding the signal contacts and the ground contacts, whereby a strip line structure is formed by the signal contacts, the ground contacts and ground shell.

22. A connector according to claim 21, wherein the ground shell is electrically connected to at least one ground connector.

23. A connector according to claim 16, wherein the cable holder comprises two holder members which can be coupled together.

24. A connector according to claim 23, wherein the cable holder is provided with a protrusion which is arranged to deform the outer coverings of the coaxial cables when the two holder members are coupled together.

25. A connector according to claim 15, wherein each ground contact has one end connected to a ground contact of a related connector, and the other end to be forced into contact with the ground conductors, said other end portion being resiliently deformable.

26. A connector according to claim 1, wherein said connector is engageable with a related connector which has signal contacts and ground contacts adapted to be fit on or in the signal contacts and the ground contacts of said connector;

said connector having a ground shell surrounding the signal contacts and the ground contacts, the related connector also having a ground shell surrounding the signal contacts and the ground contacts thereof and adapted to be fit in or on the ground shell of said connector.

27. A connector according to claim 1, further comprising a conductive cover surrounding the coaxial cables and the insulating body, said conductive cover having a through hole extending to the coaxial cable through which a potting resin or adhesive is applied to hold the coaxial cables.

28. A connector for a plurality of coaxial cables having signal conductors and ground conductors, said connector comprising:

an insulating body;

first, second and third rows of signal contacts arranged parallel to each other;

a first ground contact arranged between the first and second rows of the signal contacts;

a second ground contact arranged between the second and third rows of the signal contacts; and a ground shell surrounding the signal contacts, whereby a multi-layer strip line structure is formed by the signal contacts, the ground contacts and the ground shell;

said insulating body comprising an insulating cable holder for holding end portions of respective coaxial cables, and an insulating unit coaxially arranged with said insulating cable holder for holding first and second contact supports together;

said insulating unit comprising at least two support portions for supporting respective supports, and at least one through hole arranged between said at least two support portions for the passage of said at least one ground contact therethrough;

one end of each signal contact being soldered to a respective signal conductor of each coaxial cable, said at least one ground contact positioned through said at least one through hole of said insulating unit and having one end forcibly engaged with corresponding ground conductors of said coaxial cables or with additional conductors connected to said ground conductors.

29. A connector according to claim 28, wherein the insulating body includes a first substantially straight contact support for supporting the first row of the signal contacts parallel to each other, a second substantially straight contact support for supporting the second row of the signal contacts parallel to each other, a third substantially straight contact support for supporting the third rows of the signal contacts parallel to each other, and an insulating unit for supporting the first, second and third contact supports together, the insulating unit including support portions for supporting the contact supports, signal contact insertion holes in alignment with the support portions, and ground contact insertion slots.

30. A connector according to claim 29, wherein each signal contact is connected to a signal conductor of a coaxial cable, and each ground contact is connected to a ground conductor of the coaxial cable.

31. A connector according to claim 29, wherein the coaxial cables having signal conductors connected to the first, second and third rows of signal contacts are formed as flat cables.

* * * * *